US006116811A

United States Patent [19]

Goff

[11] Patent Number: 6,116,811

[45] Date of Patent: Sep. 12, 2000

[54] WARNING BARRICADE APPARATUS WITH LIGHTING UNIT SLEEVE

[75] Inventor: LeRoy L. Goff, Villa Park, Ill.

[73] Assignee: WLI Industries, Inc., Villa Park, Ill.

[21] Appl. No.: 09/143,485

[22] Filed: Aug. 28, 1998

[51] Int. Cl.[7] ..... E10F 13/02

[52] U.S. Cl. ..... 404/6; 404/9; 256/13.1

[58] Field of Search ..... 404/6, 9; 256/1, 256/13.1; 362/190, 191, 145

[56] References Cited

U.S. PATENT DOCUMENTS

| | | | |
|---|---|---|---|
| 3,500,378 | 3/1970 | Pickering et al. | 240/10.6 X |
| 3,604,914 | 9/1971 | Gibson | 240/2 R |
| 3,697,738 | 10/1972 | Decker et al. | 240/10.6 |
| 4,387,416 | 6/1983 | Decker | 362/190 |
| 4,475,101 | 10/1984 | Kulp et al. | 404/6 |
| 4,477,865 | 10/1984 | Tsuyama | 362/396 |
| 4,482,941 | 11/1984 | Linder | 362/186 |
| 4,624,210 | 11/1986 | Glass | 404/6 |
| 4,792,258 | 12/1988 | Goff | 404/6 |
| 5,484,225 | 1/1996 | Warner | 404/9 |
| 5,570,972 | 11/1996 | Glass et al. | 404/6 |

*Primary Examiner*—Thomas B. Will
*Assistant Examiner*—Kristine M. Markovich
*Attorney, Agent, or Firm*—Dick & Harris

[57] ABSTRACT

A warning barricade apparatus for restricting pedestrian and vehicular traffic and having an increased ability to minimize dislocation of an associated lighting unit upon vehicular impact, while also facilitating removal of the lighting unit for relocation and battery replacement. The warning barricade apparatus comprises a barricade member, an associated lighting unit, a lighting unit sleeve, and an overlaying member. The lighting unit sleeve comprises opposing retaining wall members, which define a lighting unit retention region. The overlaying member covers at least a portion of the lighting unit retention region, and preferably conforms to at least a portion of the lighting unit contour. Upon insertion of the lighting unit into the lighting unit retention region, the overlaying member comes into contact with or partially covers at least a portion of the lighting unit, and a securing member, such as a bolt, anchors the lighting unit to the lighting unit sleeve. The lighting unit sleeve distributes the force of impact over a greater area, namely the securing member, the overlaying member, and the retaining walls, thus minimizing dislocation of the lighting unit from its sleeve. An insert member, for use in association with a securing member, or a strap may also be used to secure the lighting unit in the lighting unit sleeve.

25 Claims, 2 Drawing Sheets

WARNING BARRICADE APPARATUS WITH LIGHTING UNIT SLEEVE

BACKGROUND OF THE INVENTION

1. Field of the Invention

The present invention relates in general to a warning barricade for restricting pedestrian and vehicular traffic, and more particularly, to a warning barricade apparatus having an increased ability to minimize dislocation of and damage to an associated lighting unit upon vehicular impact, while facilitating removal of the lighting unit for relocation and battery replacement.

2. Background Art

Warning barricades for use in restricting access to pedestrian and vehicular traffic have been known in the art for many years. In particular, these warning barricades have taken many different forms, including "A" frame structures, barrels, and single vertical members attached to bottom supports. Inasmuch as visibility of these barricades is tantamount to their function as a traffic restriction and a warning indicator, the use of lighting units in association with these structures has also been preferred. Specifically, lighting units are typically placed on or near the top end of these barricades, where they are most visible to an oncoming pedestrian or vehicle.

Traditionally, large battery units, such as 6-V or 12-V car-type units, were used as a source of power for these lighting units. Such large battery units were required to obtain the type of energy needed to allow continuous operation of the lighting units, without constant changing of the batteries. Because of their size and bulkiness, these batteries were placed at or near the lowest base of the barricades, with wiring running from the batteries to the lighting units which were positioned on top of the barricades.

With the increased capacity and power of smaller alkaline batteries, these smaller batteries have often replaced the larger, bulkier 6-V and 12-V batteries. These smaller (such as D-cell) batteries could be placed in the lighting unit directly, thus avoiding the wiring that was previously necessary. Accordingly, the entire lighting units, batteries included, were placed at or near the top of the warning barricades.

As a result of this development, the lighting units themselves became slightly bulkier, to even contain more mass. Thus, while some barricade structures, such as the warning barricade shown in U.S. Pat. No. 4,792,258 by Goff, are collapsible into a substantially flattened position to minimize structural damage of the barricades upon vehicular impact, these barricade designs do not necessarily accommodate the dislocation of these new, integrated, lighting units from the top of these structures. In particular, while the lighting units were improved, they also became heavier and more dangerous when forcibly displaced from, for example, the top of the barricade structures. Indeed, inasmuch as lighting units have not been adequately attached to the barricade structures, they have functioned as high speed projectiles dangerous to automobiles, automobile passengers, and any other objects in the barricade vicinity—besides subjecting the lighting units themselves to more occurrences of, and increased, damage.

The Federal Highway Administration (FHWA) has established certain crash worthiness criteria for barricades. Specifically, warning barricades are subjected to vehicular impact at 60 miles per hour. Amongst other criteria, the FHWA requires that the barricades maintain certain levels of structural integrity upon impact by a vehicle. Many states are considering legislation addressing such crash worthiness criteria, and the concern that many current barricades do not meet such requirements.

Accordingly, the present invention is directed to a warning barricade with a lighting unit sleeve that minimizes the dislocation of lighting units from the barricade upon vehicular impact, to, in turn, minimize the potential harm to nearby vehicles, passengers, and pedestrians.

Moreover, while improving the attachment of a lighting unit to warning barricade apparatus is certainly important, it also a goal in the art to minimize the hardware or materials required to securably attach the lighting unit to the warning barricade. Such a minimization of hardware reduces material costs and the time required to install lighting units on various barricades.

Furthermore, the use of alkaline batteries inside of the lighting units creates the need for quick and easy removal of the lighting unit from the barricade to facilitate battery replacement. Given the frequency with which the lighting units are damaged or stolen, and the interchangeable nature of the lighting units, the ability to quickly and easily install new units and remove damaged units is likewise desired. Accordingly, it is a further goal in the art to develop a lighting unit that is quickly and easily detached from and reattached to the warning barricade with a minimum amount of time required for the operation.

SUMMARY OF THE INVENTION

The present invention is directed to a warning barricade apparatus for restricting pedestrian and vehicular traffic and having an increased ability to minimize dislocation of an associated lighting unit upon vehicular impact, while also facilitating removal of the lighting unit for relocation and battery replacement.

The warning barricade apparatus comprises a barricade member, an associated lighting unit, a lighting unit sleeve, an overlaying member, and a securing element. The barricade member preferably comprises an upstanding member pivotally attached to two support runners. The pivotal attachment allows collapse of the upstanding member upon impact. However, the barricade member may also constitute any conventional barricade member, such as an A-frame, sawhorse, or barrel.

The lighting unit comprises a reflective lens and a base. The base consists of a removable battery storage component, front and rear apertures, and a bore hole therebetween. The bore hole, for receiving a bolting member such as a bolt, may be formed in either the removable battery storage component, or the base itself. In a preferred embodiment, the bore hole is associated with a bolt receiving member, such as threads, to receive and secure the bolting member.

Also in a preferred embodiment, the lighting unit sleeve comprises opposing retaining wall members, each having apertures which are substantially aligned to allow a bolt to pass therethrough. The retaining walls define a lighting unit retention region, configured to receive the lighting unit base.

The overlaying member is positioned to operably cover at least a portion of the lighting unit retention region. In a preferred embodiment, the overlaying member forms a sidewall for the lighting unit sleeve, joining the retaining walls. Preferably, the overlaying member is configured to substantially conform to the contour of the lighting unit base, so as to allow operative contact between the overlaying member and the lighting unit base upon insertion of the lighting unit base into the retention region.

In another preferred embodiment, the lighting unit sleeve further includes first and second sidewalls at least partially enclosing the lighting unit retention region. In this embodiment, the overlaying member preferably comprises at least a portion of the first or second sidewall. While the lighting unit sleeve may be constructed independently of and attached to the barricade member, it is preferred that the lighting unit sleeve is integrated into the structure of the barricade member by, for instance, blow molding, to obviate the need for additional hardware components. Moreover, such an integrated structure spreads the shearing forces from vehicular impact over the entire lighting unit sleeve.

Upon insertion of the lighting unit into the lighting unit retention region, the lighting unit base is placed into contact with the similarly configured overlaying member. In this position, the securing element, preferably comprising a bolting member, is inserted through one of the apertures in the retaining walls and through the lighting unit base bore hole. Here, the bolting member is either secured inside the base by the threaded bolt receiving member, or extends through the other retaining wall and out the aligned aperture to be secured by a nut, pin or other similar member.

Inasmuch as the overlaying member preferably conforms to the contour of the lighting unit base, any impact imparted on the lighting unit sleeve is distributed over not only the securing element, namely the bolt and bolt receiving member, but also over the overlaying member and opposing retaining wall members. This increased impact distribution, in turn, minimizes dislocation of the lighting unit from the barricade member upon vehicular impact.

At the same time, the single bolt required to hold the lighting unit inside the lighting unit sleeve minimizes the number of hardware components necessary for each barricade unit. Given that the lighting units are frequently exchanged or replaced because of battery expiration, destruction, or theft, the simplicity of removing or inserting one bolt minimizes the time and effort involved in exchanging or replacing lighting units.

In another preferred embodiment, an insert, having a bore hole extending therethrough, is used in conjunction with the lighting unit sleeve. In particular, the insert, like the overlaying member, is configured to conform to at least a portion of the lighting unit base. Upon insertion of the base into the lighting unit sleeve, the insert is positioned into the sleeve such that it covers at least a portion of the lighting unit base. A bolting member is then inserted through opposing retaining wall member apertures, which are aligned with the insert bore hole, and secured by a nut or other securing member. Of course, a threaded bolt receiving member may be associated with the insert bore hole instead. The insert provides an even greater area of contact between the lighting unit base and the lighting unit sleeve, while still requiring only a single bolt for securement.

In a yet another preferred embodiment, a strap, attachable to strap attachment members associated with the opposing retaining walls, may also be used to increase stabilization of the lighting unit in the lighting unit sleeve.

DETAILED DESCRIPTION OF THE DRAWINGS

Figure 3:
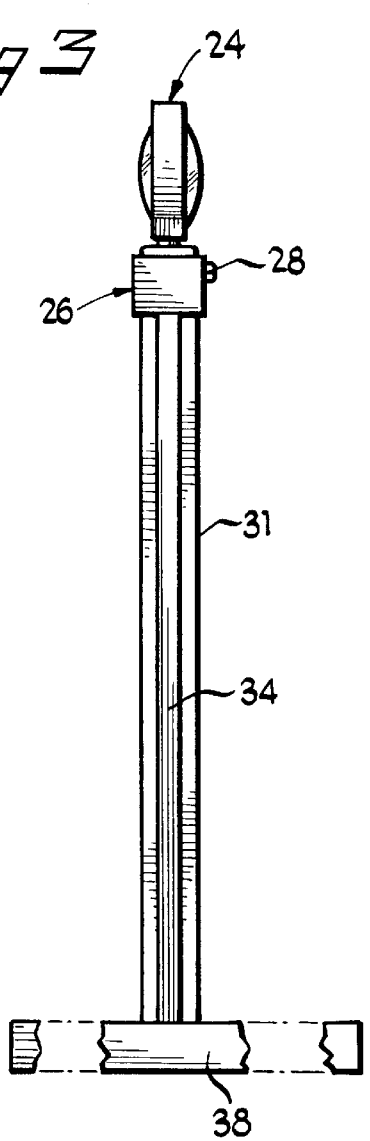
FIG. 3 of the drawings is a side elevational view of the warning barricade apparatus according to the present invention.

While the present invention is susceptible of embodiment in many different forms, there is shown in the drawings and will be described herein in detail, several specific embodiments with the understanding that the present disclosure is to be considered as an exemplification of the principles of the invention and is not intended to limit the invention to the embodiments illustrated.

Figure 2:
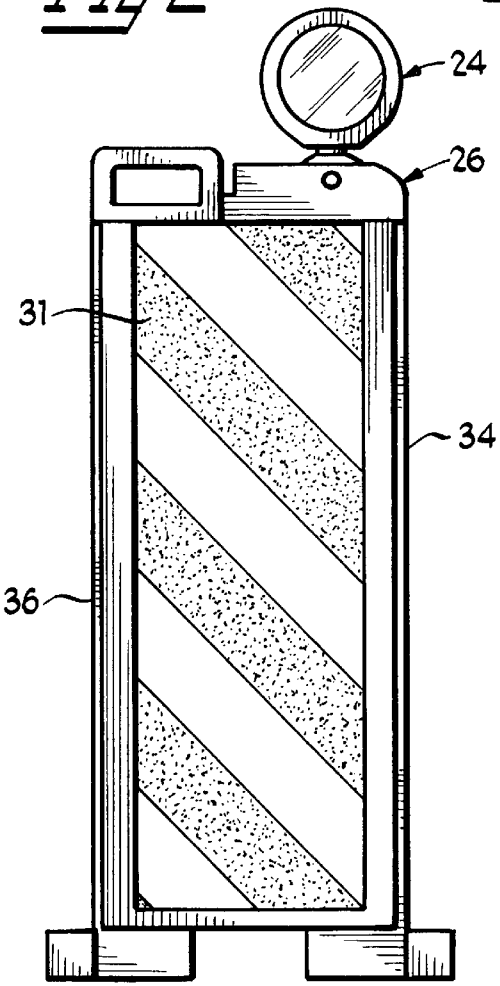
FIG. 2 of the drawings is a rear elevational view of the warning barricade apparatus according to the present invention.
Figure 1:
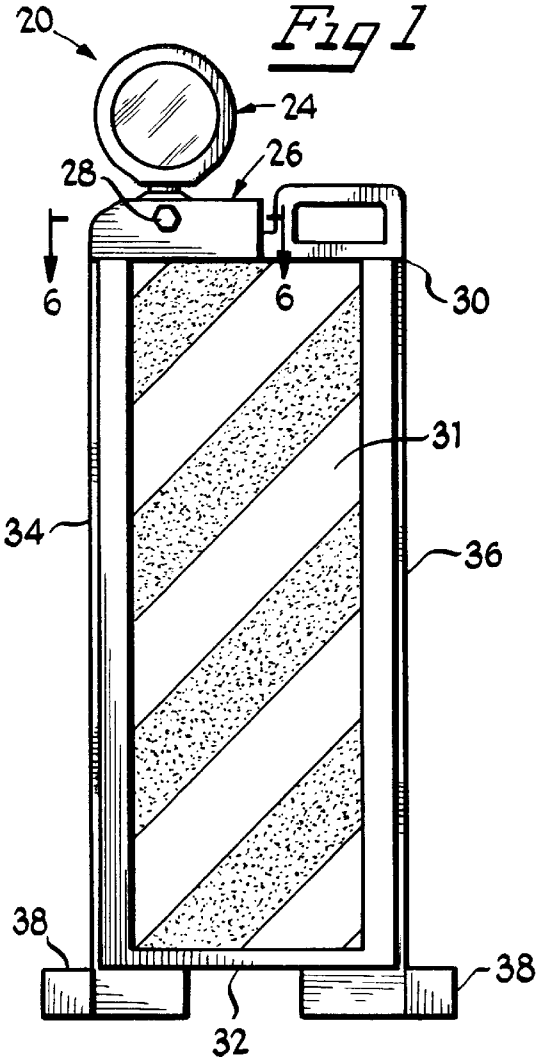
FIG. 1 of the drawings is a front elevational view of the warning barricade apparatus according to the present invention.

Warning barricade apparatus 20 for restricting vehicular and pedestrian access to a designated area is shown in FIGS. 1–3 as comprising barricade member 22, lighting unit 24, lighting unit sleeve 26, and securing element 28. Barricade member 22 preferably consists of an upstanding member 31, having top end 30, bottom end 32, first side 34, second side 36, and two support runners 38. Upstanding member 31 may be, though is not necessarily, attached to support runners 38 on a pivot, as described in U.S. Pat. No. 4,792,258 by Goff, which is incorporated herein by reference, thus making barricade member 22 collapsible upon vehicular impact. Any other barricade structures, including but not limited to other collapsible and non-collapsible structures, A-frame structures or barrel structures, are likewise contemplated for use with the present invention. Moreover, although barricade member 22 is depicted as having a single panel, it will be readily understood by those of ordinary skill in the art with the present disclosure before them that multiple panel designs are likewise contemplated, as are varying panel sizes and shapes.

Figure 4:
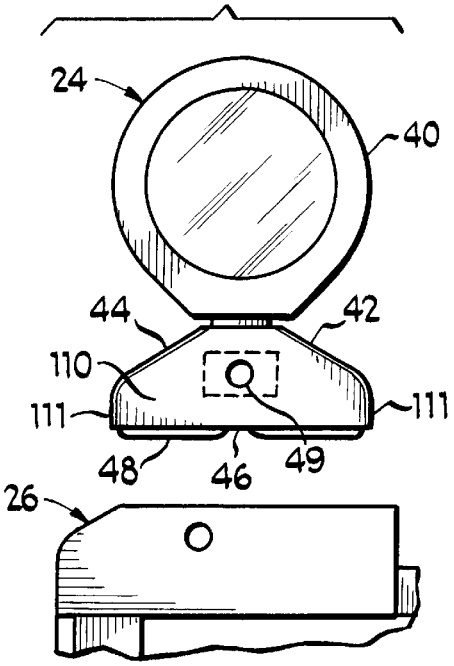
FIG. 4 of the drawings is an exploded front elevational view of the lighting unit sleeve before insertion of the lighting unit.
Figure 5:
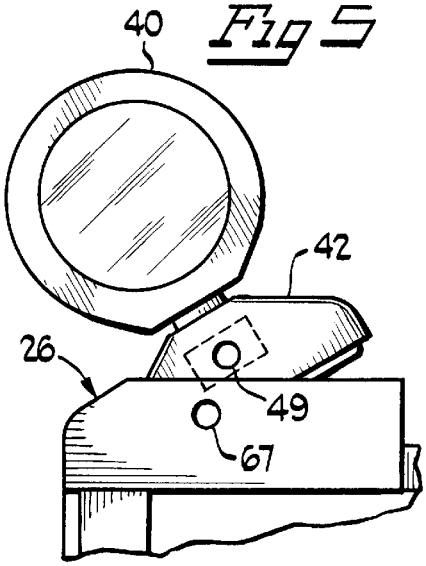
FIG. 5 of the drawings is a front elevational view of the lighting unit sleeve during insertion of the lighting unit into the lighting unit sleeve.
Figure 6:
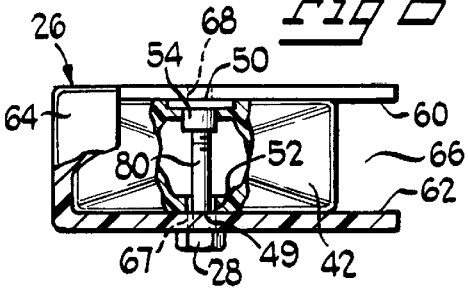
FIG. 6 of the drawings is a top plan view, in partial section, showing a portion of both the overlaying member and the lighting unit in cut away fashion, when the lighting unit is secured in the lighting unit sleeve, according to the present invention.

Lighting unit 24, also shown in FIGS. 4–6, comprises light emitting reflective lens 40 and base 42. While reflective lens 40 may be of any conventional construction, base 42 preferably consists of top portion 44, bottom portion 46, removable battery storage component 48, front aperture 49, and rear aperture 50. While top portion 44 preferably has a slanted contour for a shape, as shown in FIGS. 4 and 5, and bottom portion 46 is preferably rectangular in shape, it is likewise contemplated that base 42 may take any configuration having top and bottom portions, such as substantially circular, substantially rectangular, or substantially polygonal.

Removable battery storage component 48 substantially conforms to the inner configuration of base 42, and locks into the base by conventional means. Accordingly, battery storage component 48 may be easily removed from and reinserted into base 42. While battery storage component is preferably capable of storing four D-cell batteries, it is likewise contemplated that base 42 and battery storage component 48 may be configured to house any desired number and types of batteries, those batteries having any desired capacity. Moreover, the battery storage component is also configured to cooperate with base 42 and reflective lens 40 in producing a lighting circuit, as described in U.S. patent applications Ser. Nos. 08/778,393 and 08/777,353 by Goff, also incorporated herein by reference.

Removable battery storage component 48 further consists of bore hole 52, which is substantially aligned with both front aperture 49 and rear aperture 50 when inserted into base 42. Bore hole 52 is designed to receive a rod or bolting member, discussed in detail below. However, while bore hole 52 is preferably formed in removable battery storage component 48, it is likewise contemplated that bore hole may instead be formed in lighting unit base 42.

Moreover, in a preferred embodiment, base 42 further consists of bolt receiving member 54 positioned in association with bore hole 52. Bolt receiving member 54 preferably consists of a threaded member capable of receiving a threaded bolt to, in turn, secure the threaded bolt within base 42. Indeed, bolt receiving member 54 is preferably located proximate rear aperture 50, thus allowing the bolt to span the substantial portion of lighting unit base 42.

Lighting unit sleeve 26, shown in FIG. 6, comprises opposing retaining walls 60 and 62, and overlaying member 64. Lighting unit sleeve 26 is preferably constructed from corrugated plastic, and integrated directly into the structure of barricade member 22. Integration of the lighting unit sleeve structure may be achieved by blow-molding the sleeve during construction of the associated portion of barricade member 22. Inasmuch as integration of the sleeve with the barricade member makes additional hardware components, such as nuts, bolts, nails, etc. unnecessary, this structure provides the advantage of increased ability to withstand impact. In particular, there are no individual hardware components subject to shearing and breaking upon the force of vehicular impact. Instead, the impact is spread over the entire region of integrated joinder between the lighting unit sleeve and the barricade member. Of course, while such integration is preferred, it is readily contemplated that lighting unit sleeve 26 may be constructed of materials independent of barricade member 22, and subsequently attached after construction through any means. With such an independent construction, a base member joining the opposing retaining walls is also contemplated. Moreover, while lighting unit sleeve 26 is preferably associated with top end 30 of barricade member 22, it is also contemplated that the lighting unit sleeve may be associated with any point on the barricade member—so long as visibility of the lighting unit is not completely hampered.

Retaining walls 60 and 62 further define lighting unit retention region 66. Although retaining walls 60 and 62 are shown as having a substantially rectangular configuration, it is likewise contemplated that they may take any shape substantially conforming to the configuration of lighting unit base 42. Accordingly, retention region 66 is of an appropriate dimension to allow insertion of lighting unit base 42. Moreover, while lighting unit base 42 preferably comes into contact with both retaining walls 60 and 62 upon insertion into lighting unit retention region 66, this type of interference fit is not required. Furthermore, although retention walls 60 and 62 are shown as abutting the front and rear portions of lighting unit base 42, it is likewise contemplated that the opposing retaining walls abut opposing side portions of the lighting unit base.

Retaining walls 60 and 62 further consist of substantially aligned apertures 67 and 68, respectively. Apertures 67 and 68 are substantially aligned to allow for insertion of a bolting member through both apertures and lighting unit base bore hole 52, as is discussed in more detail below.

Overlaying member 64 is positioned so as to operably cover at least a portion of lighting unit retention region 66. Preferably, and as is shown in FIG. 6, overlaying member 64 joins opposing retaining walls 60 and 62 and is also integrated into the structure of barricade member 22, such as by the blow molding process described above. However, it is likewise contemplated that overlaying member is affixed to either or both retaining walls 60 and 62 as an independent component. If used as an independent attachable component, overlaying member 64 may be permanently affixed to one or more of barricade member 22, retaining wall 60, and retaining wall 62, or removably and replaceably affixed thereto, by, for instance, a releasable securing member, such as pins 63, screws, or bolts. Of course, the overlaying member may also fit into receiving slots, or other such securing and releasing mechanisms, as would be understood by those of ordinary skill in the art.

Overlaying member 64 is also preferably configured so as to substantially conform to the contour of lighting unit base 42 and, more specifically, to at least a portion of lighting unit base top portion 44. Such a configuration places a maximum portion of lighting unit base 42 in contact with overlaying member 64 upon insertion of lighting unit 24 into lighting unit retention region 66.

Figure 7:
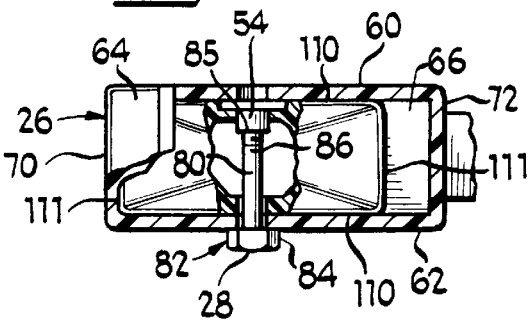
FIG. 7 of the drawings is a top plan view, in partial section, showing a portion of both the overlaying member and the lighting unit in cut away fashion, when the lighting unit secured in the lighting unit sleeve according to another embodiment of the present invention.

In another embodiment, illustrated in FIG. 7, lighting unit sleeve 26 further comprises first sidewall 70 and second sidewall 72. First 70 and second 72 sidewalls preferably connect opposing walls 60 and 62, thus enclosing lighting unit retention region 66. Moreover, like opposing walls 60 and 62, first 70 and second 72 sidewalls are preferably constructed from corrugated plastic and integrated into the structure of the barricade member.

Referring still to FIG. 7, first sidewall 70 consists at least in part of overlaying member 64. Like the lighting unit sleeve described in reference to FIG. 6, overlaying member 64 covers at least a portion of lighting unit retention region 66, towards retaining and securing at least a portion of lighting unit base 24 (described below).

Securing element 28, shown in FIGS. 6 and 7, comprises bolting member 80 and bolt receiving member 54. Bolting member 80 preferably comprises a proximal end 82 having a flange 84, and a distal end 85 having threads 86. Threads 86 are received in bolt receiving member 54, which includes a set of mating threads. However, in another embodiment shown in FIG. 9, wherein lighting unit base member 24 is constructed without a threaded bolt receiving member, securing element 28 further consists of bolt securing member 82, such as a nut or a pin, releasably securable to threaded portion 86 of bolting member 80.

In operation, and shown in FIGS. 4–6, lighting unit base 42 is inserted into lighting unit retention region 66 of lighting unit sleeve 26. Inasmuch as overlaying member 64 covers a portion of retention region 66 and preferably conforms to at least a portion of the contour of top end 44 of lighting unit base 42, lighting unit 24 may have to be manipulated for full insertion into retention region 66.

Lighting unit base 42 is then adjusted such that at least one of opposing wall apertures 77 and 78 is aligned with lighting unit base bore hole 52. In this position, at least a portion of top end 44 of lighting unit base 42 is preferably in substantial contact with overlaying member 64. At this point, bolting member 80 is placed through bore hole 52 and anchored into bolt receiving member 54 inside lighting unit base 42. Upon turning of bolt member 80, threaded region 86 mates with threaded bolt receiving member 54, thus securing lighting unit 24 inside lighting unit sleeve 26. The bolting member is preferably turned until flange 84 abuts retaining wall 60.

Alternatively, if securing member 82, such as a threaded nut, is used in place of bolt receiving member 54, bolting member 80 may be placed all the way through bore hole 52 and aperture 78. Instead of securing the bolt inside lighting unit base 42, bolt threaded distal end 85 extends out of aperture 78 and is secured by the securing member, while flange 84 again preferably abuts retaining wall 60.

Lighting unit sleeve 26 improves the distribution of impact over a greater area of the lighting unit sleeve and the lighting unit itself, thus minimizing dislocation of lighting unit 24 upon vehicular impact. In particular, the shear force generated by impact is distributed over not only the bolting member, but also over all other portions of the lighting unit sleeve in contact with the lighting unit base. Specifically, inasmuch as the overlaying member conforms to at least a portion of the shape of the lighting unit base, it facilitates distribution of the impact force over a larger surface area, thus minimizing failure of the lighting unit base, the lighting unit sleeve, and the bolting member. Indeed, minimizing failure of the barricade apparatus components increases stabilization of the lighting unit inside the lighting unit sleeve and minimizes dislocation of lighting unit 24 from barricade member 22 upon vehicular impact.

At the same time, lighting unit sleeve 26 minimizes the hardware components required to secure lighting unit 24 to barricade member 22. Because only one bolt is necessary to achieve the improved lighting unit stabilization of the present invention, both the cost associated with construction and use of warning barricades and the amount of time required to exchange and replace lighting units on barricades are minimized. In particular, because the lighting units often run on D-cell alkaline batteries, the batteries expire in the regular course of continuous use. These batteries need to be changed. Moreover, many lighting units are sometimes destroyed by vehicle collisions, or stolen. Because of the modular and interchangeable nature of the lighting units, they can be replaced quickly and easily by new units. Accordingly, the simple steps of removing the single bolt and removing the lighting unit from the lighting unit sleeve, or alternatively, inserting the lighting unit into the sleeve and securing the bolt, require very little time and effort.

Figure 8:
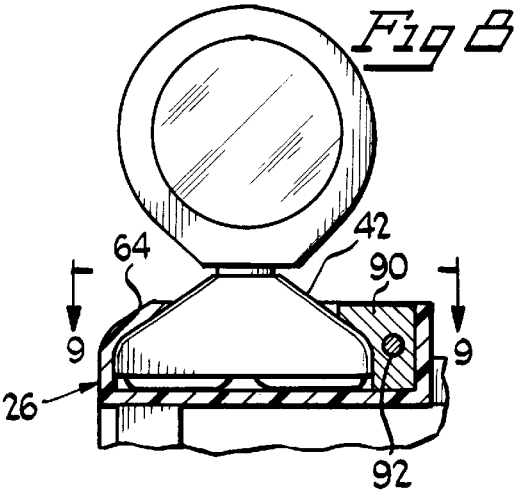
FIG. 8 of the drawings is a front elevational view of the lighting unit sleeve incorporating a stabilizing insert according to another embodiment of the present invention.
Figure 9:
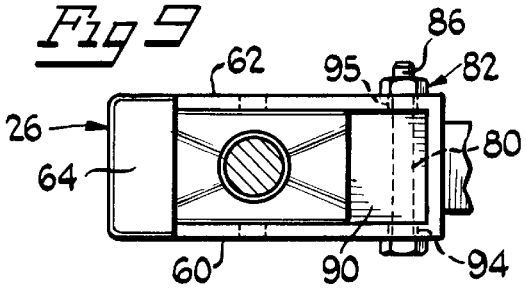
FIG. 9 of the drawings is a cross sectional view of FIG. 8 taken along the lines 9—9 and looking in the direction of the arrows.

In another embodiment, shown in FIGS. 8 and 9, the warning barricade apparatus further consists of insert member 90. Insert member 90 includes bore hole 92, extending all the way through the thickness thereof. Bore hole 92 may include a threaded bolt receiving region, like bolt receiving member 54. Moreover, like overlaying member 64, upon insertion into lighting unit sleeve 26 insert member 90 is configured to cover at least a portion of lighting unit retention region 66, and preferably conforms to the shape of at least a portion of lighting unit base 42.

In operation, lighting unit base 42 is again inserted into lighting unit retention region 66. Inside the retention region, lighting unit base 42 is forced into contact with overlaying member 64. Insert member 90 is then positioned such that insert bore hole 92 substantially aligns with apertures 94 and 95, formed in opposing walls 60 and 62, respectively. In this position, insert member 90 is in substantial contact with at least a portion of lighting unit base 42. Inasmuch as insert member 90 is preferably configured to substantially conform to the contour of lighting unit base 42, the insert member and the overlaying member combine to abut a substantial portion of the lighting unit base. In this embodiment, the lighting unit itself need not possess an aperture and nut for bolted attachment.

Next, bolting member 80 is inserted into bore hole 92 and secures insert member 90 relative to lighting unit sleeve 26. As described above in reference to bolting lighting unit base 42, bolting member 90 may be secured by a threaded bolt receiving member positioned inside bore hole 92. Alternatively, bolting member 90 may be secured by a nut or other threaded member after passing through aperture 95. Preferably, insert member 90 is used in association with the lighting unit sleeve embodied in FIG. 6 having a second sidewall. In particular, the second sidewall abuts a portion of insert member 90, thus providing additional reinforcement thereto.

Use of insert member 90 provides certain improvements to the warning barricade apparatus. In particular, the insert member provides additional areas of contact between the lighting unit base and the stabilizing lighting unit sleeve. With insert member 90, both sides of the lighting unit base are restrained, thus providing increased stabilization of the lighting unit base. Indeed, inasmuch as the insert still requires the use of only one single bolt, this increased stabilization requires no additional hardware components. Accordingly, no additional time or effort is required to remove or replace the lighting units. Of course, an additional bolt may still be inserted through and secured in the lighting unit base bore hole, as described above, if additional impact dispersion and stabilization are desired.

Figure 10:
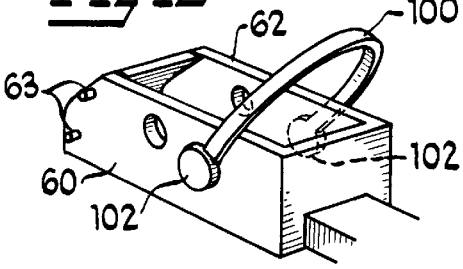
FIG. 10 of the drawings is a perspective view of the lighting unit sleeve with a retaining strap according to yet another embodiment of the present invention.

In yet another embodiment, shown in FIG. 10, strap 100 may also be used to increase stabilization of the lighting unit base inside the lighting unit sleeve. Strap 100 is preferably made of a strong, resilient material such as plastic, and is attached to opposing retaining walls 60 and 62 by strap attachment members 102. Although strap attachment members 102 are preferably permanently attached to retaining walls 60 and 62, it is likewise contemplated that they are removable and replaceable. Likewise, strap 100 is preferably detachable and reattachable to allow insertion of the lighting unit base into lighting unit retention region 66. Of course, it is contemplated that strap 100 may be used in combination with insert member 90, for maximum stabilization of the lighting unit and minimal dislocation of the lighting unit from the barricade member upon vehicle impact.

The foregoing description and drawings merely explain and illustrate the invention and the invention is not limited thereto except insofar as the appended claims are so limited, as those skilled in the art who have the disclosure before them will be able to make modifications and variations therein without departing for the scope of the invention.

What is claimed is:

1. A warning barricade apparatus for restricting vehicular and pedestrian access to a designated area, said warning barricade apparatus including a housing for a lighting unit, said lighting unit of the type having a base with top and bottom portions, two side regions, two end regions, and a shape, said apparatus operably minimizing dislocation of and damage to the lighting unit from vehicular impact with the warning barricade apparatus, while facilitating removal of the lighting unit for relocation and battery replacement, said warning barricade apparatus comprising:

a barricade member capable of being positioned in a substantially upright position, said barricade member having a top end, a bottom end, and at least two sides;

a lighting unit sleeve operably associated with at least one of said top end, bottom end, and at least two sides of said barricade member, said lighting unit sleeve having a pair of opposing retaining wall members, said pair of opposing retaining wall members defining a lighting unit retention region, each pair of opposing retaining wall members positionable substantially adjacent a respective one of said lighting unit base side regions;

an overlaying member operably associated with said lighting unit sleeve for covering at least a portion of the lighting unit retention region, said overlaying member being positioned between said retaining wall members to cover at least a portion of at least one of said two lighting unit base end regions, toward enclosing and maintaining at least a portion of said lighting unit base within said lighting unit retention region and for minimizing dislocation of said lighting unit from said lighting unit sleeve and, in turn, from said warning barricade apparatus upon vehicle impact with at least one of said barricade member, said lighting unit sleeve and said lighting unit;

at least one securing element for releasably maintaining said overlaying member in operably retaining orientation over at least a portion of said at least one lighting unit base end region and, in turn, about the base of said lighting unit to alternatively lock and release said lighting unit base, and in turn, said lighting unit, within and out of said lighting unit retention region.

2. The invention according to claim 1 wherein said lighting unit sleeve is operably associated with the top end of said barricade member.

3. The invention according to claim 1 wherein said overlaying member is operably attached to at least one of the opposing retaining wall members of said lighting unit sleeve.

4. The invention according to claim 1 wherein said overlaying member is permanently affixed to said lighting unit sleeve.

5. The invention according to claim 1 wherein at least a portion of said overlaying member is in substantial abutment with at least a portion of said top portion of said lighting unit base upon orientation of said lighting unit base fully into said lighting unit retention region.

6. The invention according to claim 5 wherein at least a portion of said overlaying member substantially conforms to the shape of at least a portion of the lighting unit base housed inside said lighting unit retention region, to promote said substantial abutment with at least a portion of same.

7. The invention according to claim 1 wherein said securing element comprises:

at least one aperture in at least one of said opposing retaining wall members;

a bore hole extending through at least a portion of said lighting unit base;

a rod member extending through at least a portion of said lighting unit base bore hole;

at least one rod retention member for securing said rod member and, in turn, said lighting unit in secured orientation within said lighting unit sleeve.

8. The invention according to claim 7 in which said at least one rod retention member comprises said rod member being threaded, and said rod retention member further comprising a mated nut member for matingly accepting and securing said threaded portion of said rod member.

9. The invention according to claim 1 wherein said lighting unit sleeve further comprises at least one sidewall member, said at least one side wall member co-operating with said opposing retaining wall members to collectively and at least partially, enclose said lighting unit retention region.

10. The invention according to claim 9 wherein said lighting unit sleeve further comprises a pair of opposing first and second side wall members, said side wall members co-operating with said opposing retaining wall members to collectively and at least partially, enclose said lighting unit retention region.

11. The invention according to claim 10 wherein said overlaying member comprises at least a portion of one of said first and second sidewalls of said lighting unit sleeve.

12. The invention according to claim 1 wherein said securing element comprises a strap member, having a first end and a second end, operably covering at least a portion of the lighting unit base upon insertion of said lighting unit base into said lighting unit sleeve.

13. The invention according to claim 12 wherein said opposing retaining wall members further include strap attachment members to secure said first and second ends of said strap member to said lighting unit sleeve.

14. The invention according to claim 1 wherein said lighting unit sleeve is integrated into the structure of said barricade member.

15. The invention according to claim 1 wherein said lighting unit sleeve is constructed from a material different than said barricade member.

16. The invention according to claim 1 wherein said lighting unit sleeve further comprises a base member joining said opposing retaining wall members.

17. A warning barricade apparatus for restricting vehicular and pedestrian access to a designated area, said warning barricade apparatus including a housing for a lighting unit, said lighting unit of the type having a base with top and bottom portions and a shape, said apparatus operably minimizing dislocation of and damage to the lighting unit from vehicular impact with the warning barricade apparatus, while facilitating removal of the lighting unit for relocation and battery replacement, said warning barricade apparatus comprising:

a barricade member capable of being positioned in a substantially upright position, said barricade member having a top end, a bottom end, and at least two sides;

a lighting unit sleeve operably associated with at least one of said top end, bottom end, and at least two sides of said barricade member, said lighting unit sleeve having a pair of opposing retaining wall members, said pair of opposing retaining wall members defining a lighting unit retention region;

an overlaying member operably associated with said lighting unit sleeve for covering at least a portion of the lighting unit retention region, between said retaining wall members, toward enclosing and maintaining at least a portion of said lighting unit base within said lighting unit retention region and for minimizing dislocation of said lighting unit from said lighting unit sleeve and, in turn, from said warning barricade apparatus upon vehicle impact with at least one of said barricade member, said lighting unit sleeve and said lighting unit;

at least one securing element for releasably maintaining said overlaying member in operably retaining orientation about the base of said lighting unit to alternatively lock and release said lighting unit base, and in turn, said lighting unit, within and out of said lighting unit retention region, and said overlaying member being removable from and replaceable on said lighting unit sleeve.

18. A warning barricade apparatus for restricting vehicular and pedestrian access to a designated area, said warning barricade apparatus including a housing for a lighting unit, said lighting unit of the type having a base with top and bottom portions and a shape, said apparatus operably minimizing dislocation of and damage to the lighting unit from vehicular impact with the warning barricade apparatus, while facilitating removal of the lighting unit for relocation and battery replacement, said warning barricade apparatus comprising:

a barricade member capable of being positioned in a substantially upright position, said barricade member having a top end, a bottom end, and at least two sides;

a lighting unit sleeve operably associated with at least one of said top end, bottom end, and at least two sides of said barricade member, said lighting unit sleeve having a pair of opposing retaining wall members, said pair of opposing retaining wall members defining a lighting unit retention region;

an overlaying member operably associated with said lighting unit sleeve for covering at least a portion of the lighting unit retention region, between said retaining wall members, toward enclosing and maintaining at least a portion of said lighting unit base within said lighting unit retention region and for minimizing dislocation of said lighting unit from said lighting unit sleeve and, in turn, from said warning barricade apparatus upon vehicle impact with at least one of said barricade member, said lighting unit sleeve and said lighting unit;

at least one securing element for releasably maintaining said overlaying member in operably retaining orientation about the base of said lighting unit to alternatively lock and release said lighting unit base, and in turn, said lighting unit, within and out of said lighting unit retention region, said securing element comprising at least one aperture in each of said opposing retaining wall members, said apertures in said opposing retaining wall members positioned in substantial alignment with one another;

a bore hole extending through said base of said lighting unit;

a bolting member, having both a proximal end and a distal end, extending through said lighting unit base bore hole and through both of said retaining wall member apertures, said bolting member having at least one threaded portion proximate said distal end and having a flange member proximate said proximal end; and a bolt securing member associated with said threaded portion of said distal end of said bolting member, said bolt securing member configured to secure said bolting member to, in turn, secure attachment of said lighting unit to said lighting unit sleeve.

19. The invention according to claim 18 wherein said bolt securing member comprises at least one of a nut, washer, and a pin.

20. A warning barricade apparatus for restricting vehicular and pedestrian access to a designated area, said warning barricade apparatus including a housing for a lighting unit, said lighting unit of the type having a base with top and bottom portions and a shape, said apparatus operably minimizing dislocation of and damage to the lighting unit from vehicular impact with the warning barricade apparatus, while facilitating removal of the lighting unit for relocation and battery replacement, said warning barricade apparatus comprising:

a barricade member capable of being positioned in a substantially upright position, said barricade member having a top end, a bottom end, and at least two sides;

a lighting unit sleeve operably associated with at least one of said top end, bottom end, and at least two sides of said barricade member, said lighting unit sleeve having a pair of opposing retaining wall members, said pair of opposing retaining wall members defining a lighting unit retention region;

an overlaying member operably associated with said lighting unit sleeve for covering at least a portion of the lighting unit retention region, between said retaining wall members, toward enclosing and maintaining at least a portion of said lighting unit base within said lighting unit retention region and for minimizing dislocation of said lighting unit from said lighting unit sleeve and, in turn, from said warning barricade apparatus upon vehicle impact with at least one of said barricade member, said lighting unit sleeve and said lighting unit;

at least one securing element for releasably maintaining said overlaying member in operably retaining orientation about the base of said lighting unit to alternatively lock and release said lighting unit base, and in turn, said lighting unit, within and out of said lighting unit retention region;

said lighting unit sleeve further comprising a pair of opposing first and second side wall members, said side wall members co-operating with said opposing retaining wall members to collectively and at least partially, enclose said lighting unit retention region; and an insert member securable in and removable from said lighting unit sleeve to secure said lighting unit base after said lighting unit base is fully positioned inside said lighting unit retention region.

21. The invention according to claim 20 wherein at least a portion of said insert member has a configuration substantially conforming to the shape of at least a portion of the lighting unit base.

22. The invention according to claim 20 wherein said insert member includes a bore hole extending therethrough for receiving a bolting member, said insert member bore hole being substantially aligned with at least one aperture in each of said opposing retaining wall members of said lighting unit sleeve.

23. The invention according to claim 22 wherein said bolting member extends through said substantially aligned apertures in said lighting unit sleeve and through said bore hole in said insert member, and is secured by a fastening member at one end.

24. The invention according to claim 22 wherein said insert member further includes a bolt receiving member associated with said insert member bore hole, configured to accept said bolting member and to secure said bolting member to said insert member.

25. A method for securing a lighting unit to a warning barricade apparatus for minimizing dislocation of said lighting unit from said warning barricade apparatus upon vehicular impact, said method comprising the steps of:

positioning a lighting unit sleeve, having a pair of opposing retaining wall members to describe a lighting unit retention region, and an overlaying member positioned between said retaining wall members and operably covering at least a portion of the lighting unit retention region, onto a barricade member capable of being positioned in a substantially upright position;

inserting a lighting unit, having a base, two side regions and two end regions, into the lighting unit retention region of said lighting unit sleeve such that each of said pair of opposing retaining wall members is positioned substantially adjacent a respective one of said lighting unit base side regions, at least a portion of one of said two end regions of said lighting unit base being operably covered by said overlaying member;

securing said lighting unit inside said lighting unit retention region such that said overlaying member operably and removably retains said lighting unit base within said lighting unit sleeve for minimizing dislocation of said lighting unit from said lighting unit sleeve and, in turn, from said warning barricade apparatus upon vehicle impact with at least one of said barricade member, said lighting unit sleeve and said lighting unit, while also allowing operative release of said lighting unit from said lighting unit sleeve for replacement and securing.

* * * * *

UNITED STATES PATENT AND TRADEMARK OFFICE

CERTIFICATE OF CORRECTION

PATENT NO. : 6,116,811
APPLICATION NO. : 09/143485
DATED : September 12, 2000
INVENTOR(S) : Goff It is certified that error appears in the above-identified patent and that said Letters Patent is hereby corrected as shown below:

| | |
|---|---|
| Col. 4, Line 59, | After "bottom portion 46", insert --side regions 110, end regions 111-- |
| Col. 4, Lines 66-67 | after "substantially polygonal", insert --Moreover, while the side regions and end regions of the lighting unit base have been shown designating specific portions of the lighting unit base, it will be readily recognized that the terms 'side' and 'end' could easily be juxtaposed.-- |

Signed and Sealed this

Thirty-first Day of July, 2007

JON W. DUDAS
*Director of the United States Patent and Trademark Office*